US011155451B2

(12) United States Patent
Grandjean et al.

(10) Patent No.: US 11,155,451 B2
(45) Date of Patent: Oct. 26, 2021

(54) LIFT TRUCK COMPRISING A LOADING STOP

(71) Applicant: COMPAGNIE GENERALE DES ETABLISSEMENTS MICHELIN, Clermont-Ferrand (FR)

(72) Inventors: Sylvain Grandjean, Clermont-Ferrand (FR); Giancarlo Pegoraro, Clermont-Ferrand (FR)

(73) Assignee: COMPAGNIE GENERALE DES ETABLISSEMENTS MICHELIN, Clermont-Ferrand (FR)

( * ) Notice: Subject to any disclaimer, the term of this patent is extended or adjusted under 35 U.S.C. 154(b) by 0 days.

(21) Appl. No.: 16/626,786

(22) PCT Filed: Jun. 22, 2018

(86) PCT No.: PCT/IB2018/054609
§ 371 (c)(1),
(2) Date: Dec. 26, 2019

(87) PCT Pub. No.: WO2019/003068
PCT Pub. Date: Jan. 3, 2019

(65) Prior Publication Data

US 2020/0115208 A1 Apr. 16, 2020

(30) Foreign Application Priority Data

Jun. 27, 2017 (FR) ..... 1770678

(51) Int. Cl.
*B66F 9/18* (2006.01)
*B66F 17/00* (2006.01)

(52) U.S. Cl.
CPC ..... *B66F 9/18* (2013.01); *B66F 17/003* (2013.01)

(58) Field of Classification Search
CPC .. B66F 9/06; B66F 9/0755; B66F 9/12; B66F 9/16; B66F 9/18; B66F 17/003
(Continued)

(56) References Cited

U.S. PATENT DOCUMENTS 1,930,486 A * 10/1933 Pitts ..... B66F 9/16 414/642
3,080,080 A * 3/1963 Miller ..... B66F 9/12 414/785

(Continued)

FOREIGN PATENT DOCUMENTS

DE 2037664 2/1972
DE 42 34 375 A1 4/1994

(Continued)

OTHER PUBLICATIONS

International Search Report dated Aug. 31, 2018, in corresponding PCT/IB2018/054609 (6 pages).

*Primary Examiner* — Glenn F Myers
(74) *Attorney, Agent, or Firm* — Venable LLP

(57) ABSTRACT

A forklift truck mounted on wheels comprises a drive system and tilting lifting means, a fork (1) adapted to lift loads with the aid of two substantially parallel arms (2) carried by uprights (3) which are substantially vertical or oblique depending on the working position, said fork (1) comprising a loading stop (10) disposed on each of the uprights (3) of the fork, each stop (10) comprising a bearing face (11) for loads having a straight profile and an angled docking face (12) for loads having a circular arc profile.

13 Claims, 3 Drawing Sheets

(58) Field of Classification Search
USPC ..... 187/222, 223, 224; 414/639
See application file for complete search history.

(56) References Cited

U.S. PATENT DOCUMENTS

| | | | | |
|---|---|---|---|---|
| 3,157,293 | A * | 11/1964 | Walters | B65C 9/06<br>414/639 |
| 2008/0011554 | A1 | 1/2008 | Broesel et al. | |
| 2009/0008951 | A1* | 1/2009 | Whetstine | H01L 21/84<br>293/120 |

FOREIGN PATENT DOCUMENTS

| | | | |
|---|---|---|---|
| EP | 1 273 717 | A1 | 1/2003 |
| EP | 3000771 | A1 | 3/2016 |
| EP | 3000772 | A1 | 3/2016 |
| FR | 2 639 932 | A1 | 6/1990 |
| JP | 2006193269 | A * | 7/2006 |
| WO | 2004/103882 | A1 | 12/2004 |
| WO | 2006/008586 | A1 | 1/2006 |
| WO | 2008/057504 | A2 | 5/2008 |

* cited by examiner

LIFT TRUCK COMPRISING A LOADING STOP

TECHNICAL FIELD OF THE INVENTION

The present invention concerns a forklift truck comprising a loading stop.

PRIOR ART

Load detection systems on a lift truck are known and used in various fields. In the fields of industry and handling, the trucks are indispensable because they enable movement of loads without effort for the operatives. Lift trucks for example enable loading, moving and heightwise positioning of a pallet.

Some lift trucks are provided with load sensing means to ensure completely safe operation. Most lift trucks provided with a sensing system are provided with a weight sensor. Thanks to a reference weight, the sensor is able to determine if the fork is loaded or not. Other examples of solutions are described hereinafter.

The document WO2006008586 describes a forklift truck comprising a weight and height sensor. The weight sensor enables measurement of a weight value of the lifted load. It is fixed to a piston of the lifting device.

The document WO2004103882 describes a forklift truck provided with a mobile load sensor for identification and surveillance of a load on the truck.

These systems with weight sensors are relatively unreliable and do not enable management of all aspects of safety in use because no data is provided relating to the correct positioning of the loads.

The document WO2008057504 describes a forklift truck comprising a load dimension sensor, implemented for example by video cameras. This system is relatively costly to use and at risk of dust and other contaminants, frequently encountered in warehouses and loading bays.

The document EP3000771 describes a forklift truck provided with an optical sensor at the level of the load carrier that can be moved at the same time as the load and an analysis unit that enables determination of the position of the load in three dimensions.

The document EP3000772 describes a forklift truck provided with an optical sensor having a first field of view and a second optical sensor movable conjointly with the load support having a second field of view. The first optical sensor enables determination of whether the load is present or not, thanks to an optical analysis unit. The second optical sensor enables determination of whether the load is correctly positioned relative to a reference position. This system, with optical modules and a logic system, is relatively complex.

Optical sensors are used in the above two documents. These sensors are fragile and have only a limited field of view. They are not suited to multiple tasks and to severe use constraints.

The document DE4234375 describes a forklift truck mounted on wheels comprising a drive system and lifting means, a fork adapted to lift loads with the aid of two substantially parallel arms 2 carried by uprights which are substantially vertical or oblique depending on the working position, said fork comprising a loading stop disposed on each of the uprights of the fork, each stop comprising a bearing face for loads having a straight profile. This system has only a flat and straight profile stop.

Moreover, in the field of logistics, situations are frequently encountered in which pallets and other specialized loads such as for example spools have to be manipulated. Such spools are encountered in the cable industry and in the tyre industry. In such cases, the logistics sites have to be equipped with more than one type of trucks suitable for handling all these types of load in complete safety.

To alleviate these various disadvantages the invention provides various technical means.

SUMMARY OF THE INVENTION

Firstly, a first objective of the invention consists in providing a forklift truck enabling transportation of loads with very different shapes and profiles, such as for example pallets and/or spools carrying cables or various strip products.

Another objective of the invention consists in providing a forklift truck with a simple load sensor.

Another objective of the invention consists in providing a forklift truck of relatively low construction cost.

Another objective of the invention consists in providing a sensing device usable for a forklift truck with or without an operator.

To that end, the invention provides a forklift truck mounted on wheels comprising a drive system and lifting means, a fork adapted to lift loads with the aid of two substantially parallel arms carried by uprights which are substantially vertical or oblique depending on the working position, said fork comprising a loading stop disposed on each of the uprights of the fork, each stop comprising a bearing face for loads having a straight profile and an angled docking face for loads having a circular arc profile.

The double profile of the bearing faces enables correct positioning of loads with a rectilinear profile such as pallets and loads with a circular arc profile such as for example spools carrying cables or various strip products. This architecture therefore enables transportation of both spools and pallets with the same machine. The lifting means can advantageously be tilted.

The fork advantageously pivots. Thanks to this feature the double profile of the bearing and docking faces is complemented by possible rearward tilting of the lifting mast, which enables transportation of pallets and spools in complete safety, including on an autonomous lift truck where nobody is present to monitor the stability of the transported load.

In accordance with one advantageous embodiment, the bearing faces are substantially perpendicular to the arms of the fork and the docking faces are on the inside edges of the uprights, adjacent to the bearing faces.

The docking faces are advantageously inclined inwards at an angle $\alpha$ to the bearing faces, said angle $\alpha$ being between 15° and 75°, and more preferably between 300 and 60°.

In accordance with one advantageous embodiment, the lift truck further comprises a load sensing module "bearing against the stop or not" on each of the loading stops and configured to generate a loading conformance signal when both modules are actuated.

In accordance with an architecture of this kind, the fact of having two stops enables detection of the correct positioning of a load with respect to each of the two arms. Thus if a load is positioned incorrectly with respect to one of the arms, a load non-conformance indication is given. An indication of this kind for example enables the function of load lifting or truck movement to be inhibited.

Each stop advantageously comprises a lever mounted to pivot between a deployed position corresponding to an absent load and a retracted position corresponding to a load that is present and positioned correctly. This simple and relatively low cost arrangement is particularly suitable for severe use constraints.

In accordance with one advantageous variant, the angled docking face extends longitudinally over at least a portion of each of the pivoting levers.

In accordance with one advantageous embodiment, the stop consists of a longitudinal body adapted to be positioned along the lifting axis AL of the fork, the pivoting lever including a pivot pin substantially at the mid-height of the longitudinal body of the stop. This system is robust and easy to retrofit to already existing machines. Procuring this system is therefore relatively inexpensive.

In accordance with another advantageous embodiment, the "load absent or not bearing on the stop" position of the pivoting lever corresponds to a position in which the free end of that lever is at a distance from the base of the longitudinal body.

In accordance with another advantageous embodiment, the "load present and bearing against the stop" position of the pivoting lever corresponds to a position in which the free end of that lever is substantially docked with the base of the longitudinal body.

This configuration enables easy detection of the presence and correct positioning of load. For example, the load comes to bear against the stop when it is loaded and positioned correctly. Because of this, the free end of the pivoting lever is positioned against the base of the longitudinal body.

The detection module advantageously includes a position sensor adapted to detect the retracted position of the pivoting lever.

The position sensor enables validation and/or confirmation that the load is present and positioned correctly.

Likewise, the position sensor is advantageously of inductive type. This sensor is relatively inexpensive, reliable and easy to install.

Likewise, the lift truck is advantageously an autonomous truck. This type of truck is more and more common in the logistics field and it is extremely useful that it is able to provide autonomously not only the movement functions but also those relating to safety, more particularly in relation to the quality of loading of the loads transported.

In accordance with one advantageous embodiment, the load sensing module comprises a positioning anomaly detection sub-module adapted to generate an anomaly signal when only one of the two actuatable stops is activated.

In the event of an anomaly, this device enables the lifting and/or moving operations to be stopped for safety reasons.

The free end of the pivoting lever advantageously comprises a longitudinal finger enabling the lever to be extended on the outside of the adjoining arm independently of the angular position of the lever.

This device makes it possible to prevent failure of detection in the case of a load with a thin profiled shape, liable to pass under the pivoting lever. The load nevertheless bears on the lever via the finger situated on the side making it possible to validate the presence of a load on the fork.

DESCRIPTION OF THE FIGURES

Full execution details are given in the following description, complemented by FIGS. 1 to 5, which are provided by way of nonlimiting examples only and in which.

DETAILED DESCRIPTION OF THE INVENTION

Figure 1:
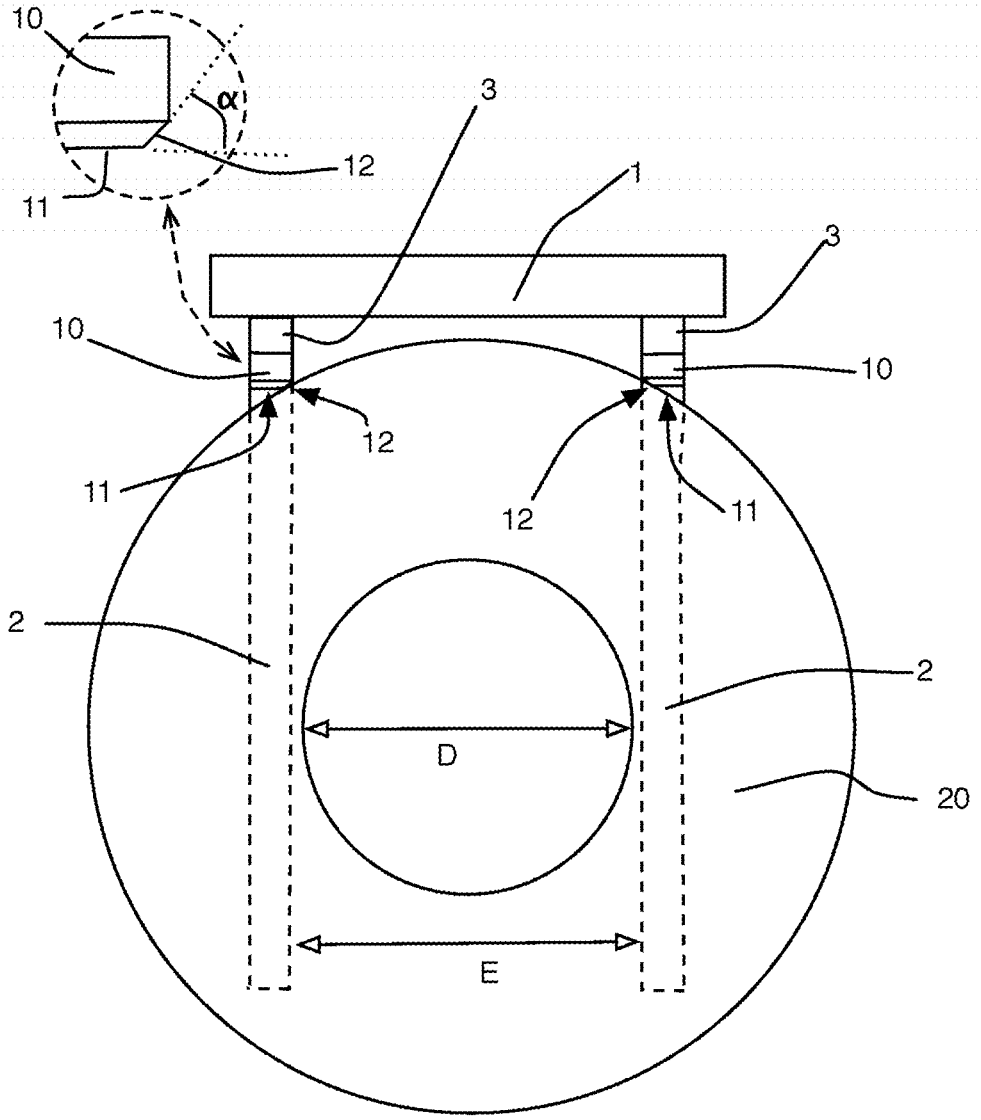
FIG. 1 is a diagrammatic view from above of one example of a forklift truck with a detection system according to the invention.
Figure 2A:
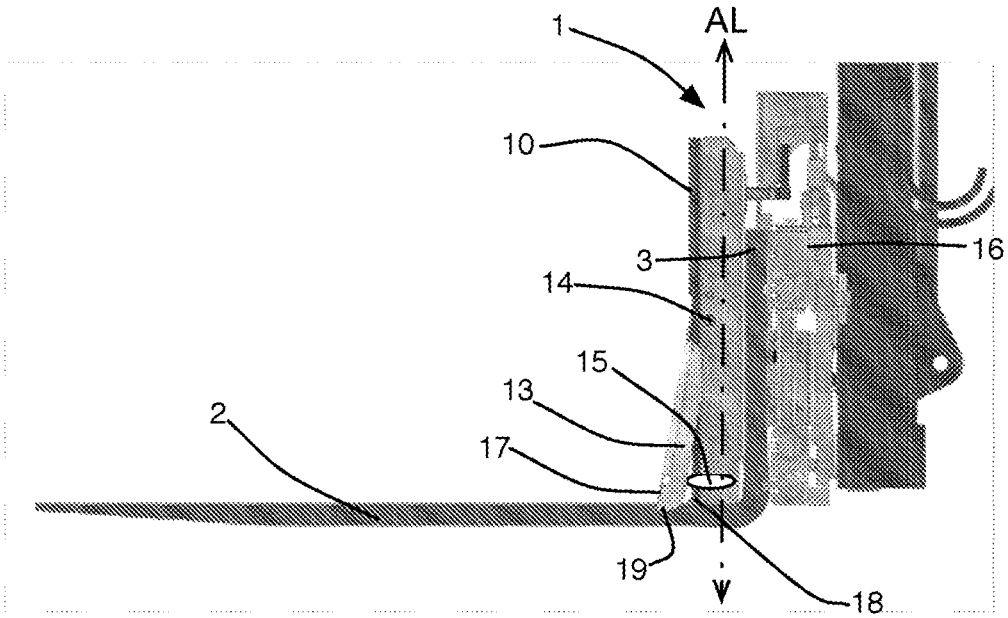
FIG. 2A shows the truck from FIG. 1 seen in elevation with the pivoting lever in the deployed position.
Figure 2B:
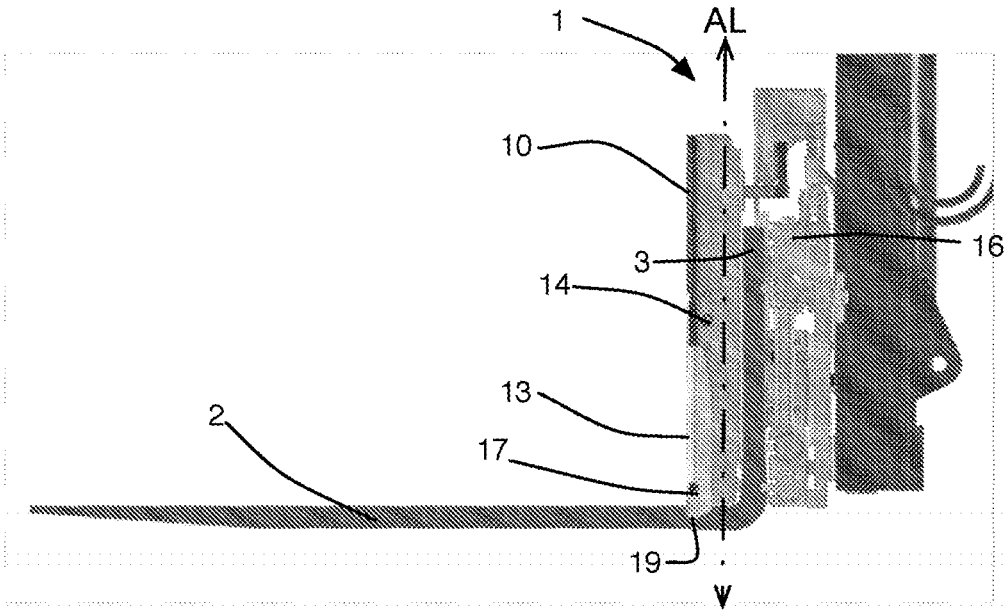
FIG. 2B shows the truck from FIG. 1 seen in elevation with the pivoting lever in the retracted position.

FIG. 1 and FIGS. 2A and 2B show one embodiment of a fork truck 1. A truck conventionally comprises two uprights 3 that are usually substantially vertical or oblique depending on the working position. The uprights 3 carry arms 2 extending toward the front of the truck. These arms are substantially parallel and are generally inserted in insertion tunnels of various types provided in transport pallets. The uprights 3 enable the arms 2 to be lifted to lift a pallet to be transported and to enable a pallet to be placed or picked up at a height.

The fork includes two loading stops 10, i.e. a stop for each of the uprights 3 of the fork. As shown in FIGS. 2A and 2B, each stop 10 consists of a longitudinal body 16 adapted to be positioned along the lifting axis AL of the upright of the fork 1. As shown in FIG. 1 and more particularly in the enlarged area of FIG. 1, each stop 10 includes a pallet bearing face 11 for loads having a rectilinear profile, such as for example a pallet, and a docking face 12 suitable for loads having a circular arc profile, such as for example spools carrying cables or various strip products. The bearing face 11 is substantially perpendicular to the arm 2 of the fork 1 that extends in front of it. It occupies at least 50% of the width of the loading stop 10 on which it is disposed. This arrangement enables a load having a rectilinear leading face, such as for example a pallet, to bear on all of the width of the bearing face. The docking faces 12 are on the inside edges of the loading stops 10, adjacent to the bearing faces 11. The docking faces are inclined inwards relative to the bearing faces. As shown in the enlarged portion of FIG. 1, the angle $\alpha$ formed between the two faces is advantageously between 15° and 75°, and more preferably between 30° and 60°. The width of the docking face 12 is preferably less than 50% of the width of the bearing face 11.

In accordance with a variant embodiment that is not shown, the docking face 12 is extended over the pivoting lever 13 so as to adapt to the profile of the load in bearing engagement. This embodiment enables the docking face to remain available for guiding the load from the deployed position of the pivoting lever 13 (see FIG. 2A) to its retracted position (see FIG. 2B).

The stops enable the assurance of correct positioning of the load. The twin-profile stop is particularly effective in facilitating positioning of loads the contour of which is rounded or circular, such as for example spools carrying cables or various strip products.

In the example from FIG. 1, a spool or a stack of spools 20 is loaded onto the arms 2 and comes to bear on the docking faces 12 of the stops 10. The distance E between the arms 2 is substantially slightly greater than the diameter D of the core of the spool.

In one advantageous embodiment the lift truck also provides a module for detecting a load bearing against the stop 10, arranged at the level of each of the loading stops 10.

FIGS. 2A and 2B enable the showing of the components of those modules and the mode of operation.

FIG. 2A is a diagrammatic side view of the truck from FIG. 1. The loading stop 10 shown is positioned against an upright 3 of the fork 1 extending along the lifting axis AL. A pivoting lever 13 is fixed to the stop 10, in this example at mid-height of the stop, by a pivot pin 14. This arrangement enables the lever 13 to pivot between a deployed position shown in FIG. 2A, corresponding to an absent load, and a retracted position shown in FIG. 2B, corresponding to a load present and correctly positioned. The bearing face 11 and the docking face 12 described above are advantageously arranged as much at the level of the pivoting levers 13 as at the level of upper portions of the stops so as to extend over all the available height, thus making it possible to facilitate bringing any load into bearing engagement, whatever its height.

The free end of the pivoting lever 13 is extended by a longitudinal finger 19 that is located on the outside of the adjacent arm 2. This finger is sufficiently long to extend under the arm regardless of the angular position of the pivoting lever 13. It enables detection of a possible thin load that would not be detected by one or the other of the faces 11 or 12.

The load detection module is configured to generate a loading conformance signal when the two pivoting levers 13 are in the retracted position. To detect this position the stops 10 are advantageously provided with position sensors 15 (see FIG. 2A) adapted to detect the retracted position of each of the pivoting levers 13. Inductive, magnetic, vision cell, beams e.g. laser beams and other types of detectors are used for example.

In order to alert operators to an abnormal or risk situation, the load sensing module preferably comprises a positioning anomaly detection sub-module able to generate an anomaly signal if only one of the two actuatable stops is activated.

Figure 3:
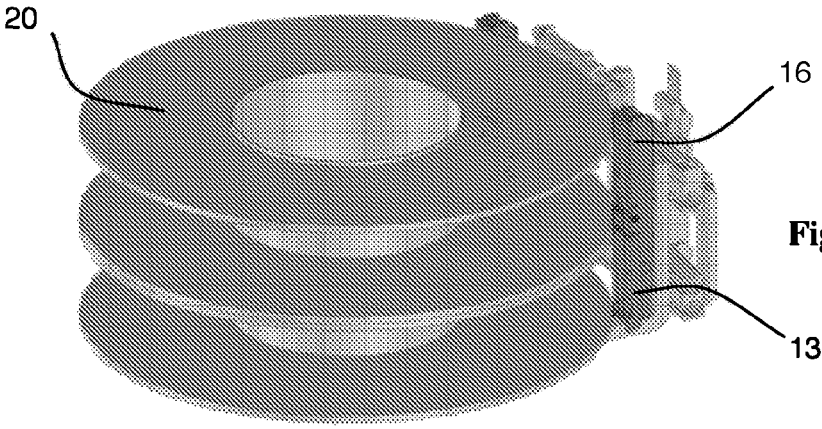
FIG. 3 is a perspective view of the truck from FIG. 1 carrying a spool or a stack of spools to be transported.
Figure 4:
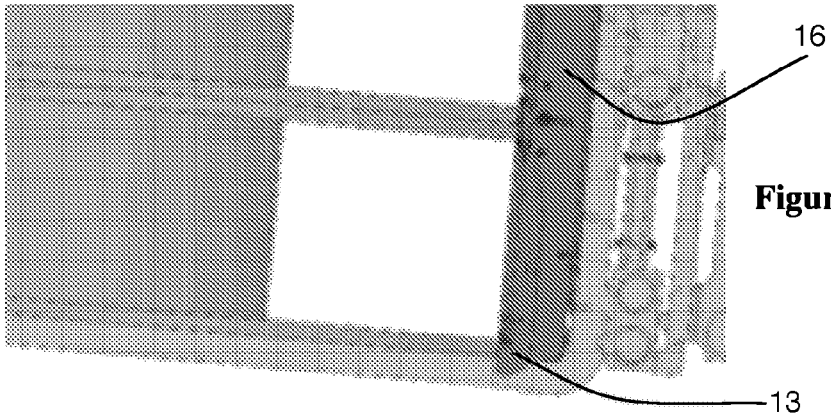
FIG. 4 is an enlarged side view of the truck from FIG. 3.
Figure 5:
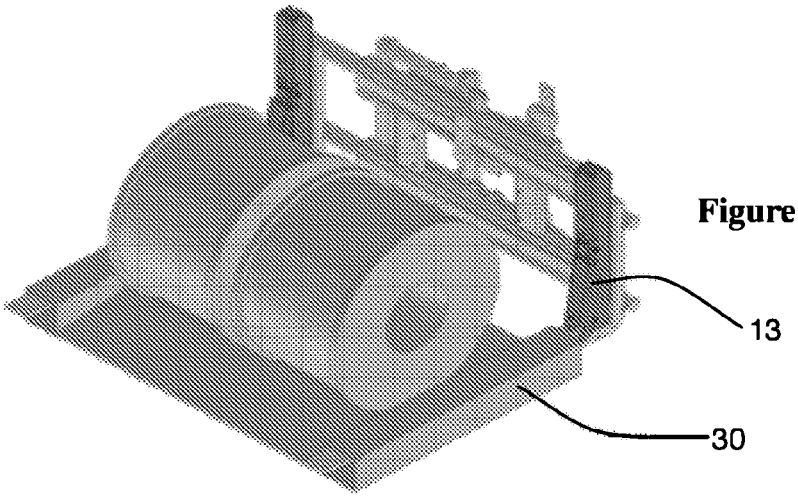
FIG. 5 is a perspective view of the truck from FIG. 1 with a variant load.

FIGS. 3 to 5 show examples of the configuration of a truck according to the invention. In FIG. 3 a spool or a stack of spools of industrial cable is placed on the arms. Note the retracted position of the levers and the correct alignment of the spool by means of the docking faces 12. FIG. 4 is a view of FIG. 3 to a larger scale in which is seen the position of the lever 13 bearing against the longitudinal body 16, indicating adequate positioning. FIG. 5 shows another example of use of the truck with a handling pallet 30, the multiple use characteristics of the truck being clearly shown.

REFERENCE NUMBERS EMPLOYED IN THE FIGURES

1. Fork
2. Fork arm
3. Fork upright
10. Loading stop
11. Pallet bearing face
12. Docking face
13. Pivoting lever
14. Pivot pin
15. Position sensor
16. Longitudinal body
17. Free end of pivoting lever
18. Base of longitudinal body
19. Longitudinal finger
20. Spool of cable or wire
30. Handling pallet
AL Lifting axis

The invention claimed is:

1. A forklift truck mounted on wheels comprising a drive system and a fork adapted to lift loads, the fork having two substantially parallel arms carried by uprights which are substantially vertical or oblique depending on a working position, wherein the fork comprises a loading stop disposed on each of the uprights of the fork, each loading stop comprising a bearing face for loads having a straight profile and an angled docking face for loads having a circular arc profile, and wherein each bearing face is substantially perpendicular to the arms of the fork and each docking face is on an inside edge of an upright, adjacent to each bearing face.

2. The forklift truck according to claim 1, wherein each docking face is inclined inward at an angle a to a bearing face, the angle a being between 15° and 75°.

3. The forklift truck according to claim 1, wherein the fork pivots.

4. The forklift truck according to claim 1 further comprising a load sensing module bearing against each of the loading stops and configured to generate a loading conformance signal when both modules are actuated.

5. The forklift truck according to claim 4, wherein each loading stop comprises a lever mounted to pivot between a deployed position corresponding to a load being absent or to not bearing against the loading stop and a retracted position corresponding to a load bearing against the loading stop.

6. The forklift truck according to claim 5, wherein each angled docking face extends longitudinally over at least a portion of each of the pivoting levers.

7. The forklift truck according to claim 5, wherein each loading stop consists of a longitudinal body adapted to be positioned along a lifting axis of the fork, the pivoting lever including a pivot pin substantially at a mid-height of the longitudinal body.

8. The forklift truck according to claim 7, wherein the deployed position of the pivoting lever corresponds to a position in which a free end of the pivoting lever is at a distance from a base of the longitudinal body.

9. The forklift truck according to claim 7, wherein the retracted position of the pivoting lever corresponds to a position in which a free end of the pivoting lever is substantially docked with a base of the longitudinal body.

10. The forklift truck according to claim 5, wherein the load sensing module includes a position sensor adapted to detect the retracted position of the pivoting lever.

11. The forklift truck according to claim 10, wherein the position sensor is an inductive-type sensor.

12. The forklift truck according to claim 4, wherein the load sensing module comprises a positioning anomaly detection submodule adapted to generate an anomaly signal when only one of the two actuatable loading stops is activated.

13. The forklift truck according to claim 5, wherein a free end of the pivoting lever comprises a longitudinal finger enabling the pivoting lever to be extended on an outside of the adjoining arm independently of an angular position of the pivoting lever.

* * * * *